United States Patent [19]

Neely

[11] 3,992,199

[45] Nov. 16, 1976

[54] METHOD OF MAKING ELECTRICAL CONTACT MATERIALS

[75] Inventor: Lloyd F. Neely, Indianapolis, Ind.

[73] Assignee: P. R. Mallory & Co. Inc., Indianapolis, Ind.

[22] Filed: Dec. 18, 1975

[21] Appl. No.: 641,750

Related U.S. Application Data

[62] Division of Ser. No. 421,276, Dec. 3, 1973, Pat. No. 3,951,872.

[52] U.S. Cl. ..... 75/200; 75/213; 29/182; 29/420.5; 29/182.1

[51] Int. Cl.[2] ..... B22F 3/16

[58] Field of Search ..... 252/513, 514, 515; 29/182, 182.7, 182.1, 420.5; 75/200, 226

[56] References Cited

UNITED STATES PATENTS

| | | | |
|---|---|---|---|
| 2,030,229 | 2/1936 | Schwarzkopf | 75/221 X |
| 2,179,960 | 11/1939 | Schwarzkopf | 29/182 X |
| 2,620,555 | 12/1952 | Lenz | 75/200 X |
| 2,648,747 | 8/1953 | Graves | 75/200 X |
| 2,843,921 | 7/1958 | Ang | 29/182 |
| 3,859,087 | 1/1975 | Backstrom | 75/213 |

*Primary Examiner*—Benjamin R. Padgett
*Assistant Examiner*—E. Suzanne Parr
*Attorney, Agent, or Firm*—Hoffmann, Meyer & Hanson

[57] ABSTRACT

An electrical contact material consisting essentially of a highly conductive metal such as gold or silver, a refractory constituent such as tungsten, molybdenum, tantalum, titanium, their carbides, or mixtures thereof and a bonding constituent of at least two metals that form an alloy selected from the iron group (Group VIII of the Periodic Table of the Elements), and copper. The material has improved properties including improved resistance to arc erosion, resistance to bleeding of the highly conductive metal, and resistance to welding or sticking when used as an electrical contact material.

10 Claims, No Drawings

METHOD OF MAKING ELECTRICAL CONTACT MATERIALS

This is a division of application Ser. No. 421,276, filed Dec. 3, 1973, now U.S. Pat. No. 3,951,872.

This invention relates to metallurgy, and more particularly to improved electrically conductive materials that are suited for a variety of uses, especially for use as electrical contact material.

For an electrical contact material to function efficiently, especially at high current levels, it should contain constituents having the properties of high electrical conductivity to carry an electrical current efficiently and high thermal conductivity to dissipate generated heat. Conductive metals such as silver (Ag), gold (Au) and copper (Cu) possess both of these properties and are, therefore, logical choices for use in electrical contacts. However, these metals, when used in their substantially pure form in a contact carrying high current values are subject to severe arc erosion, that is, degradation of the contact face due to an electrical arc forming between contact faces or working surfaces during making and breaking of electrical circuits, thereby vaporizing metal from the working surface of each contact. At high current levels, contacts of Au, Ag or Cu also experience the problems of welding or sticking. This occurs in operation when portions of the surfaces of two contacts melt due to high current and fuse together. Melting of the surfaces of the contacts is caused by the heat generated due to either electrical arcing or the inherent electrical resistance of the contact opposing the current flow according to the formula $I^2R$. If the mechanical force operating the contacts is sufficient to pull them apart, the contact surface may become irregular or pitted due to portions of the metal of one contact surface adhering or transfering to the other contact surface. If the mechanical force is not sufficient to pull the contact surfaces apart, the contacts are welded or stuck together and will not be able to perform their required function of making and braking electrical circuits.

It has been a practice to include a high melting point refractory material with the conductive metal (Ag, Au, Cu) in electrical contact materials to help minimize the problems of arc erosion and welding associated with the conductive metal. Typical high melting point refractory materials which have been used are tungsten (W), molybdenum (Mo), tantalum (Ta), titanium (Ti) and their carbides. Contacts using such a combination of materials have generally been constructed of refractory material particles formed into a skeleton with a matrix of conductive metal. In such a contact, the conductive metal (Ag, Au, Cu) provides the current carrying thermal conductivity properties while the refractory metal (W, Mo, Ta, Ti or their carbides) contributes hardness, resistance to arc erosion and anti-weld properties.

The composition of a contact material containing a conductive metal and a refractory metal or refractory compound can be varied to yield materials with slightly different electrical and physical properties. If a higher electrical conductivity is desired, the percentage of the conductive metal in the contact composition is increased. If higher hardness or greater resistence to arc erosion or welding is desired, the percentage of the refractory material in the contact composition is increased. Other factors which influence the electrical and physical properties of these materials are the method of fabrication, the particle size of the refractory material powder used to make the contact, and the use of additives.

Even in the use of refractory materials with a high conductivity metal such as Ag, Au or Cu for contact materials, contacts made from these materials are still subject to significant arc erosion and welding at high current levels. Erosion becomes a serious problem when these contact materials are used in certain applications such as circuit breakers for interrupting high amperage currents. Contact resistance also increases when the contacts of these materials carry rated currents for long periods of time. An increase in contact resistance thereby increases the heat generated when current flows through the contact. Refractory metal and high conductivity metal containing contact materials, when used in a contact, are also affected by the problem of the high conductivity metal liquifying and bleeding out of the refractory metal containing skeleton when subjected to high currents. Such bleeding results in a reduced amount of the highly conductive metal in the contact, especially at the working surface of the contact, and thereby reduces the overall electrical conductivity of the contact since the refractory metal component typically has a much lower electrical conductivity than the highly conductive metal constituent.

A reduction in arc erosion rate and welding and bleeding characteristics in a contact material usually results in contacts that are able to carry higher currents, are more reliable, and have a longer useful life in operation.

It is therefore a feature of the invention to provide an electrical contact material having a high resistance to arc erosion at elevated current levels. Another feature of the present invention is that the contact material has less tendency to bleed the high conductivity metal when used in electrical contacts in high current operations. It is another feature of the invention that the contact material has a high resistance to welding or sticking. Another feature of the invention is that the electrical contact material has good conductivity. Another feature of the invention is that the electrical contact material has high mechanical strength.

These and various other features of this invention as well as many specific advantages will be more fully apparent from a detailed consideration of the remainder of this disclosure including the accompanying examples and the appended claims.

Generally, this invention relates to an improved electrically conductive material, especially well adapted for use in electrical contacts. The electrical contact material is composed of a highly conductive metal, a refractory constituent and a bonding constituent. More specifically, the highly conductive metal of the material is an effective amount of a metal selected from the group of Au and Ag. The refractory constituent is an effective amount of refractory materials selected from the group of W, Mo, Ti, Ta, carbides of these metals or mixtures thereof. The bonding constituent is an effective amount of at least two metals selected from copper (Cu) and Group VIII of the Periodic Table of the Elements, that is, iron (Fe), nickel (Ni), cobalt (Co), ruthenium (Ru), rhodium (Rh), palladium (Pd), osmium (Os), iridium (Ir) and platinum (Pt).

Preferably, the refractory constituent of the conductive material of the present invention contains two or more refractory metals or their carbides since materials containing two or more refractory metals or their carbides have a significantly greater resistance to arc erosion than materials containing but one refractory metal or refractory metal carbide. Altering the weight ratios of the two metals in the refractory constituent of the material has a significant effect on the relative resistance to arc erosion of the material. Altering the weight ratio of the components of the bonding constituent has little or no effect on material performance such as arc erosion, but deleting one component from the bonding constituent causes the material to erode much more than the known binary refractory metal-conductive metal materials. The presently preferred material is composed essentially of Ag from about 12 wt.% to about 69 wt.%, a refractory constituent of W and Mo from about 30 wt.% to about 85 wt.% and a bonding constituent composed of Ni and Cu from an effective amount to about 3.0 wt.% each. The weight ratio of W to Mo is about 1:4 to about 4:1. The most preferred material is composed essentially of about 20 wt.% to about 55 wt.% Ag, about 53 wt.% to about 40 wt.% W, about 26 wt.% to about 14 wt.% Mo, an effective amount up to about 1 wt.% Ni, and an effective amount up to about 1 wt.% Cu. In the most preferred material the weight ratio of W to Mo is about 1:4 to 4:1.

Material compositions of the present invention may be made by several methods using powder metallurgy techniques. One method is to mix powders of the refractory and bonding constituents, press the powder into a porous compact, and then sinter the compact. The conductive metal is placed in close contact with the sintered compact and heated above the melting point of the conductive metal, the metal then fills pores of the porous compact.

Another method is to mix all the constituents in powder form, press the powders into a compact, and sinter the compact. A repressing operation on the sintered compacts may be used to increase the density of the compact or to control the geometry of the configuration of the final product.

A third method is to mix powders of all the constituents, press the powders into a porous compact, and then simultaneously sinter and infiltrate the compact with the conductive metal by placing the conductive metal in close proximity to the compact.

Another method is to mix powders of each of the constituents, heat so as to frit the powders into particles, grind to break up the particles, press the ground particles into a compact in the shape of an electrical contact, and then sinter the pressed compact.

The material of the invention may also be made by hot pressing the mixed powders of all the constituents into the desired shape.

Preferred compositions and their physical properties are more clearly shown by the following examples and the accompanying test data. It should be understood that the examples are given for the purpose of illustrations and do not limit the invention as has been described to those particular examples.

EXAMPLE I

A conductive material of the composition of about 53 wt.% Ag, about 30 wt.% W, about 15 wt.% Mo, about 1 wt.% Cu and about 1 wt.% Ni is made by a fritting process. The process comprises mixing the powders of all the constituents together, heating so as to frit the powders into particles, grinding to break up the particles, pressing the ground particles to the shape of an electrical contact, and then sintering.

The resultant electrical contact is compared to two electrical contacts of conventional contact materials of substantially the same size by subjecting three contacts of each composition to twenty contact operations at 3000 amperes current. The results of the test are summarized in TABLE I.

TABLE I

| | SHORT CIRCUIT TEST RESULTS 220 VAC 45 – 50% PF 3000 AMP | | | | | |
|---|---|---|---|---|---|---|
| MATERIAL | CURRENT DURATION (CYCLES) | WEIGHT LOSS (MG) MOVING | STATION | TOTAL | MG/OP | VOLUME LOSS (cc × $10^{-3}$ |
| A | 24.5 | 650.5 | 777.4 | 1427.9 | 71.39 | 4.81 |
| A | 27.5 | 663.0 | 805.2 | 1468.2 | 73.41 | 4.95 |
| A | 25.0 | 641.9 | 730.7 | 1372.6 | 68.63 | 4.63 |
| Average | 25.7 | 651.8 | 771.1 | 1422.9 | 71.14 | 4.80 |
| B | 26.0 | 547.3 | 609.4 | 1156.7 | 57.88 | 4.35 |
| B | 25.5 | 540.0 | 557.7 | 1097.7 | 54.88 | 4.12 |
| B | 25.5 | 547.9 | 593.0 | 1140.9 | 57.05 | 4.29 |
| Average | 25.7 | 545.1 | 586.7 | 1131.7 | 56.60 | 4.25 |
| C | 21.5 | 368.6 | 367.8 | 736.4 | 36.82 | 3.13 |
| C | 21.0 | 345.5 | 344.5 | 690.0 | 34.50 | 2.93 |
| C | 21.5 | 348.5 | 332.3 | 680.8 | 34.04 | 2.89 |
| | 21.3 | 354.2 | 348.2 | 702.4 | 35.10 | 2.98 |

Material A, a conventional contact material, is composed of about 35 wt.% Ag and about 65 wt.% W. Material B, another conventional contact material, is composed of about 49 wt.% Ag and about 51 wt.% W. Material C is the conductive material of the invention as given in EXAMPLE I.

As TABLE I indicates, the contacts composed of the conductive material of this invention have significantly lower weight losses per operation due to arc erosion in the test than do the contacts of the conventional contact materials under the same test conditions. The average weight loss per operation for the three contacts of the invention composition is about 49% of the average weight loss per operation for the three contacts of composition A and is about 62% of the average weight loss per operation for the three contacts of composition B. Thus the reduction shown is from about one third to one half for the contacts of the invention composition. In terms of comparative volume loss, the average loss of the contacts of the invention composition is about 62% of that of the average of the contacts of composition A and is about 70% of that of the average of the contacts of composition B. None of the contacts sustained any welding during the testing.

A visual examination of the three contact types after testing reveals significant cracking on the surfaces of the contacts composed of conventional materials A and B, while surfaces of the contacts of the invention composition show minimal or no cracking. A visual examination of the three types of contacts also reveals that there is significantly heavier silver bleed-out on the contacts composed of conventional material than on the contacts of the invention composition. The bleeding in the contacts composed of the conventional material manifests itself as a substantially continuous ring around the contact composed of small globules of silver in this particular test.

EXAMPLE II

Three electrical contacts of varying composition are made according to this invention by an infiltration process. The three compositions of the contacts D, and E and F are set forth in TABLE II. The contact material are prepared by mixing powders of the refractory (W and Mo) and bonding (Ni and Cu) constituents, pressing the mixed powders into a porous compact, sintering the porous compact, placing silver in close proximity to the compact, and then heating the compact and silver above the melting point of Ag so as to fill the compact with Ag.

The three contacts composed of the invention composition are tested along with a conventional contact of composition G, the composition also set forth in TABLE 2, by subjecting the contacts to short circuits of approximately 1500 amperes. The results of the testing are summarized in TABLE II.

TABLE II

| Contact Material | D | E | F | G |
|---|---|---|---|---|
| Composition (wt. %) | | | | |
| Ag | 43.4 | 43.9 | 41.8 | 48.65 |
| W | 51.8 | 37.1 | 38.1 | 51.35 |
| Mo | 4.0 | 18.0 | 19.0 | — |
| Ni | 0.8 | 0.9 | 0.9 | — |
| Cu | 0.2 | 0.9 | 0.2 | — |
| Volume Loss ($cc \times 10^{-3}$)/short circuit test | 2.87 | 1.64 | 1.59 | 3.89 |
| % Erosion of conventional contact material | 74 | 42 | 41 | 100 |

The contacts D, E and F of the invention composition show significantly less erosion due to arcing than does the conventional contact in identical tests. On two of the contacts, E and F, the loss of volume due to erosion is less than half that of the contact of the conventional material.

TABLE II also indicates that the ratio of the weight percents of the refractory constituents (W and Mo) to each other seems to be directly related to the arc erosion rate characteristic of the material and that the ratio of the weight percents of the bonding constituents (Ni and Cu) has no significant relationship to the arc erosion rate characteristic of the material. However, a contact made of the composition of about 48.2 wt.% Ag, about 25.4 wt.% W, about 25.4 wt.% Mo and about 1.0 wt.% nickel (copper omitted) shows an arc erosion rate significantly higher than the conventional material under the same testing, seemingly indicating that at least a binary bonding constituent is necessary to have the improved arc erosion characteristics of this invention.

In another qualification test, contacts of the invention composition of TABLE II are placed in a 100 ampere rated device and are able to withstand three short circuit operations at about 5000 amperes while as contact composed of conventional material similar to the conventional material G of TABLE II, when placed in the same device could not withstand the same 5000 ampere current short circuit operation.

The presence of small amounts of impurity elements is not believed to play a critical role in the invention. It should be understood that it is contemplated that minor amounts of other elements can be added to the materials and such practices are considered to be within the invention herein described.

Thus the invention as herein disclosed includes improved metallurgical conductive materials, especially well suited for use in electrical contacts, that exhibit improved properties such as resistance to arc erosion, resistance to bleeding and resistance to sticking or welding.

The present invention is not intended to be limited to the disclosure herein, and changes and modifications may be made by those skilled in the art without departing from the spirit and scope of the present invention. Such modifications and variations are considered to be within the perview and the scope of the present invention and the appended claims.

I claim:

1. A method of making a highly conductive-refractory metal containing type electrical contact material consisting essentially of about 12 wt.% to about 69 wt.% of electrically conductive metal selected from Ag and Au and mixtures thereof, about 30 wt.% to about 85 wt.% total of at least two refractory constituents selected from W, Mo and Ta, and an effective amount up to about 6 wt.% of a bonding constituent consisting essentially of at least two metals that are capable of forming an alloy with each other selected from the group of Cu and the metals of Group VIII of the Periodic Table of the Elements comprising the steps of mixing powders of all the constituents, pressing the mixed powders into a compact and sintering the compact to provide the electrical contact material.

2. The method according to claim 1 wherein the compact is repressed after sintering.

3. The method according to claim 1 wherein the electrically conductive metal is Ag, the refractory constituent is W and Mo, and the bonding constituent is Ni and Cu.

4. The method according to claim 3 wherein the electrical contact material consists essentially of about 53 wt.% Ag, about 30 wt.% W, about 15 wt.% Mo, about 1 wt.% Ni and about 1 wt.% Cu.

5. A method of making a highly conductive-refractory metal containing type electrical contact material consisting essentially of about 12 wt.% to about 69 wt.% of electrically conductive metal selected from Ag and Au and mixtures thereof, about 30 wt.% to about 85 wt.% total of at least two refractory constituents selected from W, Mo and Ta, and an effective amount up to about 6 wt.% of a bonding constituent consisting essentially of at least two metals that are capable of forming an alloy with each other selected from the group of Cu and the metals of Group VIII of the Periodic Table of the Elements comprising the steps of mixing powders of the refractory metals and powders of the bonding constituent, pressing the mixed powders into a porous compact, sintering the compact, filling void spaces of the porous compact with the molten conductive metal, and cooling the compact to provide the electrical contact material.

6. The method according to claim 5 wherein the electrical conductive metal is Ag, the refractory constituent is W and Mo, and the bonding constituent is Ni and Cu.

7. The method according to claim 6 wherein the electrical contact material consists essentially of about 53 wt.% Ag, about 30 wt.% W, about 15 wt.% Mo, about 1 wt.% Ni and about 1 wt.% Cu.

8. A method of making a highly conductive-refractory metal containing type electrical contact material consisting essentially of about 12 wt.% to about 69 wt.% of electrically conductive metal selected from Ag and Au and mixtures thereof, about 30 wt.% to about 85 wt.% total of at least two refractory constituents selected from W, Mo and Ta, and an effective amount up to about 6 wt.% of a bonding constituent consisting essentially of at least two metals that are capable of forming an alloy with each other selected from the group of Cu and the metals of Group VIII of the Periodic Table of the Elements comprising the steps of pressing powders of the refractory constituent and the bonding constitiuent into a porous compact, simultaneously sintering the compact and infiltrating the compact with the molten conductive metal, and cooling to provide the electrical contact material.

9. The method according to claim 8, wherein the electrically conductive metal is Ag, the refractory constituent is W and Mo, and the bonding constituent is Ni and Cu.

10. The method according to claim 9 wherein the electrical contact material consists essentially of about 53 wt.% Ag, about 30 wt.% W, about 15 wt.% Mo, about 1 wt.% Ni and about 1 wt.% Cu.

* * * * *